US006159065A

United States Patent [19]

Jung et al.

[11] Patent Number: 6,159,065

[45] Date of Patent: Dec. 12, 2000

[54] METHOD FOR MANUFACTURING A SPACER FOR A FLAT PANEL DISPLAY

[75] Inventors: Sung Jae Jung; Kwang Je Woo; Kwan Soo Kim; Gwon Jin Moon, all of Kyungsangbuk-Do, Rep. of Korea

[73] Assignee: Orion Electric Co., Ltd., Kyungsangbuk-do, Rep. of Korea

[21] Appl. No.: 09/143,497

[22] Filed: Aug. 28, 1998

[30] Foreign Application Priority Data

| | | | |
|---|---|---|---|
| Aug. 29, 1997 | [KR] | Rep. of Korea | 97-43046 |
| Sep. 30, 1997 | [KR] | Rep. of Korea | 97-50242 |
| Sep. 30, 1997 | [KR] | Rep. of Korea | 97-50243 |
| Aug. 21, 1998 | [KR] | Rep. of Korea | 98-34068 |

[51] Int. Cl.[7] ..... H01J 9/00; H01J 9/24

[52] U.S. Cl. ..... 445/24; 445/23

[58] Field of Search ..... 445/24, 23; 313/495, 313/292

[56] References Cited

U.S. PATENT DOCUMENTS

| | | | |
|---|---|---|---|
| 5,136,207 | 8/1992 | Miyake et al. | 313/582 |
| 5,205,770 | 4/1993 | Lowrey et al. | 445/24 |
| 5,949,184 | 9/1999 | Ohoshi et al. | 313/485 |

*Primary Examiner*—Kenneth J. Ramsey
*Assistant Examiner*—Michael J. Smith
*Attorney, Agent, or Firm*—Merchant and Gould P.C.

[57] ABSTRACT

The present invention relates to a method for manufacturing a spacer used in a flat panel display. At the first printing process, a printing mask produces a primary spacer on a substrate. After removing the printing mask, a supporting plate having a hole to excess the primary spacer is placed on the substrate and then the printing mask is rearranged on the supporting plate. A subsequent printing process is applied repeatedly to the printing mask with the supporting plate to extend the height of the primary spacer to the amount of the thickness of the supporting plate, thereby producing an elongated finished spacer.

9 Claims, 10 Drawing Sheets

METHOD FOR MANUFACTURING A SPACER FOR A FLAT PANEL DISPLAY

FIELD OF THE INVENTION

The present invention relates to a method for manufacturing a spacer employed in a flat panel display such as a field emission display(hereinafter referred to a FED), and more particularly to a method for manufacturing a spacer in a flat panel display wherein a supporting plate is interposed between a substrate and a printing mask in order to extend a height of the spacer.

BACKGROUND OF THE INVENTION

Recently, as the VLSI semiconductor manufacture technology and ultra high vacuum technology are rapidly being developed, the search for a triode device having a micron size which has new formation is becoming active. And the flat panel display is observed to develope a new flat display which has merits of CRT and LCD by applying the device to the display device.

FED is a type of a flat display, which emits cold electrons by applying relatively low voltage, for example about 200~10 kV using a phenomenon in which electric field concentrates in the edge portion of the screen. FED is formed using the phenomenon has both the merits of high definition of CRT and the thin property of LCD, so it is observed as a display of the next generation.

The FED constitutes cathode of a tip form or wedge form which emits electrons and anode which is deposited with fluorescent material. It guides the emission of an electron from a number of micro tips, and displays a desired picture using light generated in the process in which the most outer electrons are excited and are in transition when the fluorescent material is stimulated.

That is, in FED, electrons emit out of a vacuum from the solid state through tunnelling of quantum mechanics if electric field is applied to the metal or conductor in the vacuum, and they are accelerated by the voltage applied to the electrode behind the opposite side and impinge on the fluorescent layer formed on the electrode to emit light. This is a display device to display image.

The FED not only can be thinly manufactured but can solve the faults of LCD: the process yield, unit price of production and large size of LCD. That is, LCD has the property that the entire product becomes spoiled even if there is fault in one unit pixel. However, since the FET has a number of smaller unit pixels in one group of pixel, there is not a problem in the operation of pixel group even if there are defects in one or two unit pixels. Therefore, the yield of an entire product increases.

Moreover, FED has superior properties to that of the LCD, that is, visual field angle, luminance, speed of response and power consumption. So FED is suitable for a large display device.

An early FED consists of conical emitters which are exposed to the exterior by a cavity and has an edge portion, gates which are lined up in both sides of the emitter and anodes which are parted from the gates in a fixed gap, and where each of them corresponds to the cathode, grid and anode of CRT.

The FED emits electrons using the electric field concentrated in the edge portion of the anode by applying the voltage to the emitter, and the emitted electrons are guided by the anode to which a positive voltage is applied and make the fluorescent covered on the anode emit. In additon, the gates control the direction and quantity of electrons.

The FED has a spacer in order to maintain a fixed gap between upper panel and lower panel.

The spacer is a structure which protects the substrate from being destroyed or bended by the pressure stress due to the high vacuum in the FED and maintains the upper and lower panels in the gap of 100~3000 $\mu$m conventionally.

The FED needs to have a gap between substrates, where the gap is more than 1 mm for a panel of high luminance and the high emission efficiency although the gap of substrate is in the range of 100~3000 $\mu$m. However, to make the height of spacer for FED to about 2000 $\mu$m, there has been many problems technically, so many formation methods of spacer to solve those problems are being raised.

In the conventional methods to form such a spacer, there are photolithography method in which material for spacer is deposited on the lower panel on which cathode array and gate electrode are formed and it is patterned a method for scattering minute particles for spacer on the substrate, a method for manufacturing a spacer using individual process and arranging the spacer on the lower panel, or printing method.

However, the above described methods each have serious problems. The photolithography method has an advantage in manufacturing a minute spacer, but it has a complex process of patterning the spacer material after forming the photosensitive film on the material formed with spacer material and removing the photosensitive film pattern which is remained where there is a difficulty of selecting material for spacer. And the method for scattering minute particles for spacer on the substrate is difficult to manufacture panel of high density and can destroy cathode tips in case that the particles are scattered on the entire panel.

Also, in the case that the spacer is manufactured and arranged in individual process, it is difficult to arrange and fix the spacer to the correct position, and the printing method can apply and use the isolation wall formation method being used in the conventional PDP but it has a fault that a high spacer can not be formed with a narrow width. It is due to the fact that it becomes difficult to control the condition of process since the gap between the top portions of mask and printed page is changed and the print pressure is also changed as the stack print is executed over and over again, and becomes difficult to form a thick spacer since the accumulated print thickness for one print decreases gradually as the stack print is executed because the portion printed already is inserted to the following mask pattern hall.

SUMMARY OF THE INVENTION

It is, therefore, an object of the invention to provide a method for manufacturing an elongated spacer by employing a plurality of printing supporting members.

In accordance with one aspect of the present invention, there is provided a method for manufacturing a spacer used in a flat panel display, comprising the steps of:

(a) placing a printing mask on a substrate, wherein the printing mask is provided with a plurality of holes, each exposing a portion to be expected to be the spacer on the substrate;

(b) printing the printing mask with a paste to fill it within the holes to produce a plurality of base spacers and drying the base spacers;

(c) positioning a supporting plate between the substrate and the printing mask, wherein the supporting plate is provided with a plurality of holes which exposes their corresponding base spacers; and (d) arranging the printing mask on the supporting plate to apply a subsequent printing process to the printing mask to extend the base spacer with a desired height.

In accordance with further another aspect of the present invention, there is provided a method for manufacturing a spacer used in a flat panel display, comprising the steps of:

(a) forming a recess in a portion expected to be the spacer on a substrate;

(b) arranging a printing mask on the substrate, wherein the printing mask has a hole to expose the recess;

(c) printing the printing mask to fill a paste within the hole to produce a base spacer and drying the primary spacers;

(d) positioning between the substrate and the printing mask a supporting plate whose thickness is substantially similar to that of the base spacer, wherein the supporting plate is provided with a hole which exposes the base spacer;

(e) arranging the printing mask on the supporting plate to apply a subsequent printing and drying processes to the printing mask to extend the base spacer with a desired height.

In accordance with another aspect of the present invention, there is provided a method for manufacturing a spacer used in a flat panel display, comprising the steps of:

(a) forming a subsidiary member at both sides of a portion expected to be the spacer on a substrate;

(b) arranging a printing mask on the substrate, wherein the printing mask has a hole to expose the portion;

(c) printing the printing mask with a paste to fill it through the holes to define a base spacer;

(c) positioning between the substrate and the printing mask a supporting plate whose thickness is substantially similar tothat of the base spacer, wherein the supporting plate is provided with a hole which exposes the base spacer;

(e) arranging the printing mask on the supporting plate to apply a subsequent printing and drying processes to the printing mask to extend the base spacer with a desired height; and (f) removing the subsidiary member from the substrate.

BRIEF DESCRIPTION OF THE DRAWINGS

The above and other objects and features of the present invention will become apparent from the following description of preferred embodiments given in connection with the accompanying drawings, wherein.

DETAILED DESCRIPTION OF THE PREFERRED EMBODIMENTS

Figure 1A:
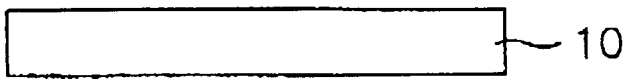
FIGS. 1A to 1H show a sequence of manufacturing a spacer for used in a flat panel display in accordance with a preferred embodiment of the invention.
Figure 1B:
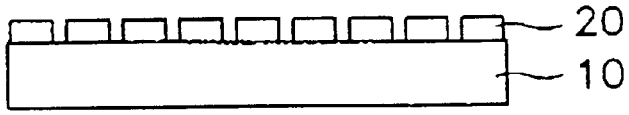
Figure 1C:
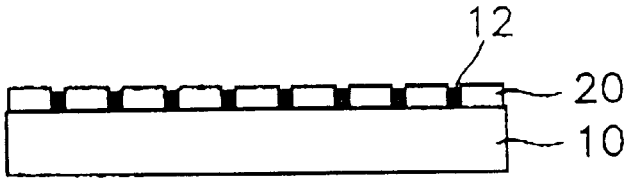
Figure 1D:
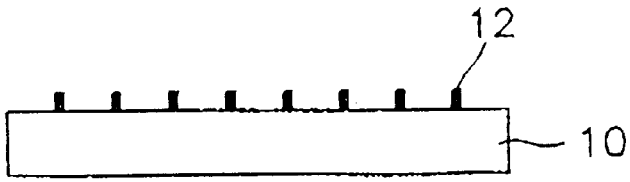
Figure 1E:
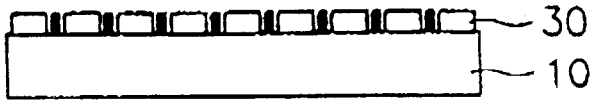
Figure 1F:
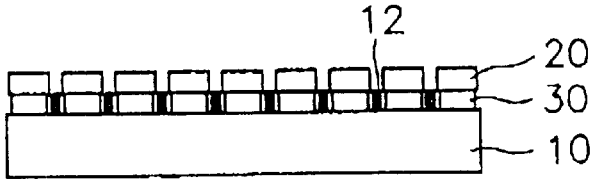
Figure 1G:
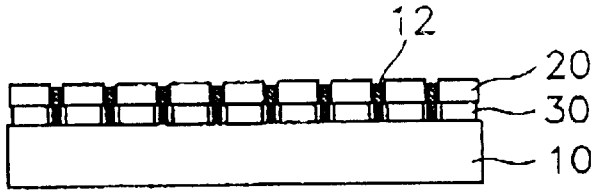
Figure 1H:
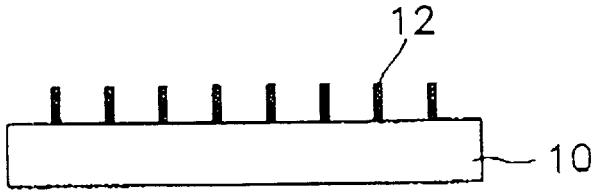

Referring to FIG. 1A to 1H, there is shown a procedure of manufacturing a spacer in a flat panel display in accordance with a first embodiment of the present invention in which a supporting plate is provided between a substrate and a printing mask.

A printing mask 20 is positioned on a substrate 10. The printing mask 20 is provided with a plurality of holes 22, each exposing a portion expected to be a spacer 12 on the substrate 10. The printing mask 20 is printed with a paste to fill it through the holes 22 to produce a plurality of base spacers 12 and the base spacers 12 are then dried at all once. The substrate may be made into any of an anode plate and a cathode plate; however, it is preferred that the substrate be an anode in consideration of the breakage of the tip. Furthermore, it is preferable that the base spacers 12 formed by the printing mask 20 do not exceed in its height a ¾ of the overall thickness of the printing mask 20, as shown in FIG. 1A to 1D.

After removing the printing mask from the substrate 10 to leave the base spacers 12, a supporting plate 30 is aligned on the substrate 10. The supporting plate 30, whose thickness is substantially similar to that of each of the base spacers 12, is also provided with a plurality of holes 32 which expose their corresponding base spacers 12 therethrough. Thereafter, the printing mask 20 is placed again onto the supporting plate 30. And then, a set of subsequent printing processes is applied to the printing mask 20 so that each of the base spacers 12 is extended to the amount of the thickness of the printing mask 20 to define an elongated spacer 12 with a desired height. The elongated spacer is then subjected to a heat treatment to form a finished spacer 12. The supporting plate 30 may be made by any available materials. (See, FIGS. 1*e* to 1*h*).

In this embodiment, the finished spacer 12 may be solidified by the drying process for once at the completion of all of the subsequent printing processes or may be repeatedly solidified for each of the printing processes.

It is preferred to make the finished spacer 12 have an appropriate height and width in consideration of the printing property and evacuation conductance. It is known by an experiment that the upright length of the spacer 12 is proper about 2.3 mm; however, it should be understood to those who are skilled in the art that both of the upright length and the number of the spacers to be formed on an unit area of the substrate may be changed with unconscious factors in the experiment; and therefore a detailed description will be omitted.

An overall shape of the supporting plate 30 is substantially looks similar to that of the printing mask; however, each of the holes 22 in the printing mask 20 should be larger than that of the supporting plate 30 in order not to be hindered by the supporting plate 30 during the subsequent printing processes.

Figure 2:
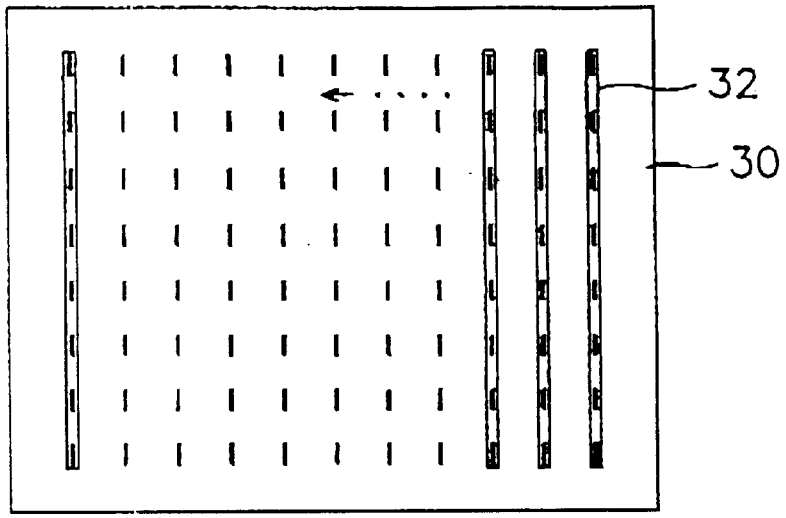
FIG. 2 is an exemplary plan view of a type of the supporting member employed in FIG. 1E.

The supporting plate 30, for example, as illustrated in FIG. 2, has a plurality of slits, each of the slits being capable of enclosing all of the spacers running in a row. Alternatively, the supporting plate 30, as illustrated in FIG. 3, has a plurality of rectangular holes 32 as described with reference to FIG. 1, wherein the rectangular holes 32 are slightly larger than that of the printing mask.

Figure 3:
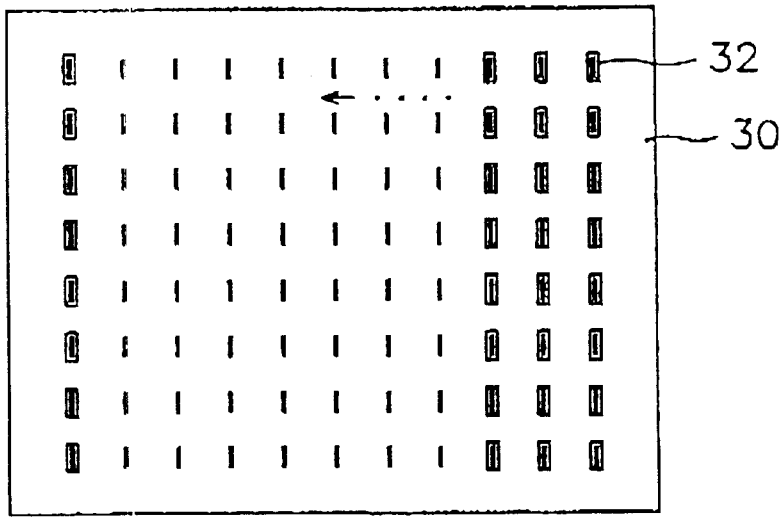
FIG. 3 is an examplary plan view of another type of the supporting member employed in FIG. 1E.
Figure 4A:
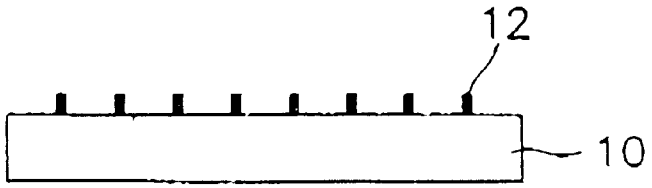
FIGS. 4A to 4F depict a procedure of manufacturing a spacer used in a flat panel display in accordance with a second preferred embodiment of the invention.
Figure 4B:
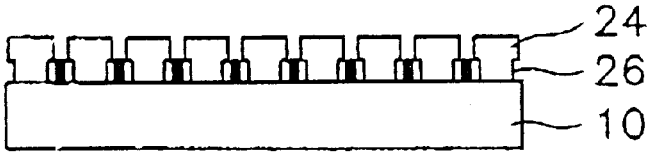
Figure 4C:
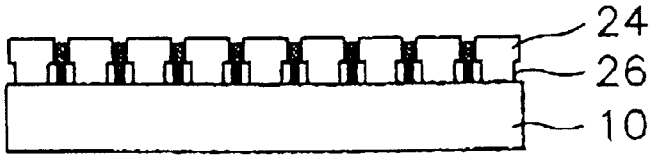
Figure 4D:
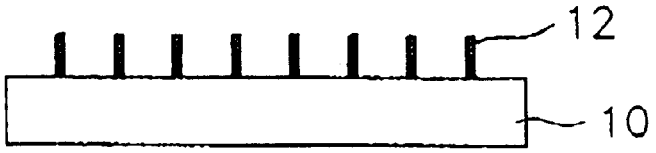
Figure 4E:
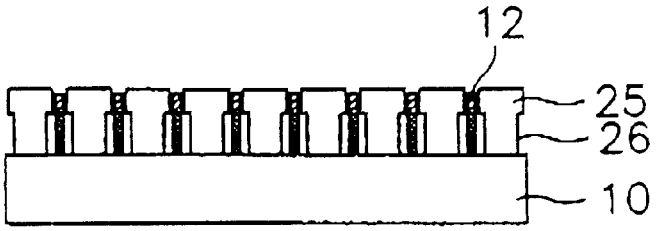
Figure 4F:
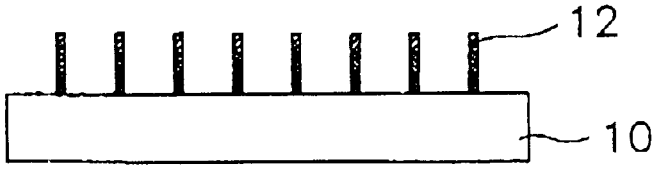

Such a supporting plate as shown in FIGS. 2 or 3 may be fixed on the substrate by bonding its one end on the substrate through the use of a tape or an adhesive at the outset of its arrangement on the substrate, which eliminates the labour to align the supporting plate on the substrate and remove it therefrom.

In the subsequent printing processes, it is noted that an additional supporting plate is continuously needed in order to raise the height of the spacer. Alternatively, the additional supporting plate may be provided once for every a set of two or more subsequent printing processes.

FIGS. 4A to 4F illustrate a procedure of manufacturing a spacer in a flat panel display in accordance with a second embodiment of the present invention wherein a printing mask incorporates a supporting member.

The sequential steps of FIGS. 1*a* to 1*d* using a printing mask 20 are performed. First, a spacer 12 is formed on a substrate 10 (refer to FIG. 4*a*). A first modified printing mask 24 having a support layer 26 is disposed on the substrate 10, and the second printing is carried out thereon, thereby increasing a height of the spacer 12. Here, the support layer 26 is operated identically to the support plate of the first embodiment of the present invention. The support layer 26 may be formed at the lower portion of the first modified printing mask 24 by developing and drying a photoresist film, or may be adhered to the printing mask by means of an adhesive tape of a predetermined thickness (refer to FIGS. 4*b* and 4*c*).

Thereafter, the first modified printing mask 24 is removed, and the third printing is performed by using a second modified printing mask 25 having a higher support layer 26. As a result, the spacer 12 can be formed to have a preferable height (refer to FIGS. 4*d* to 4*f*).

Although the above embodiment is described with relation to the first and the second modified printing mask, the modified printing mask may be repeatedly employed multiple times if necessary until the spacers will have a desired height.

In the above described embodiment, the second modified printing mask has a thicker lower layer than that of the first modified printing mask and has a larger pattern width than that of the first modified printing mask.

Figure 5:
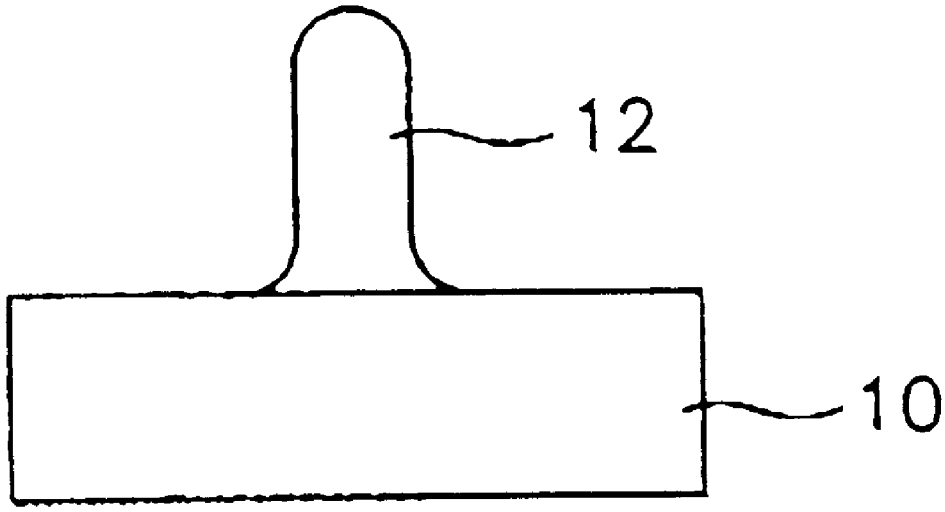
FIG. 5 is a diagram for explaining the spread of a paste for the spacer.

Normally, as shown in FIG. 5, the paste is apt to outwardly and widely spread to render the primary spacer expanded at its base or bottom at the first printing sequence rather than the subsequent printing sequence. In order to avoid the expanded base, it is necessary to control the amount of the paste. In accordance with the invention, it can be achieved by way of reducing the thickness and pattern width of the modified printing mask which will be applied to the first printing sequence. As a result, the reduced printing mask needs a reduced amount of the paste, to thereby yield a narrow pattern of the spacer. Furthermore, each of the printing masks, which will be used in sequence during subsequent printing procedures, has a gradually increased thickness and pattern width.

FIGS. 6A to 6B and 7A to 7B show a printing mask used in a third embodiment of the present invention.

Figure 6A:
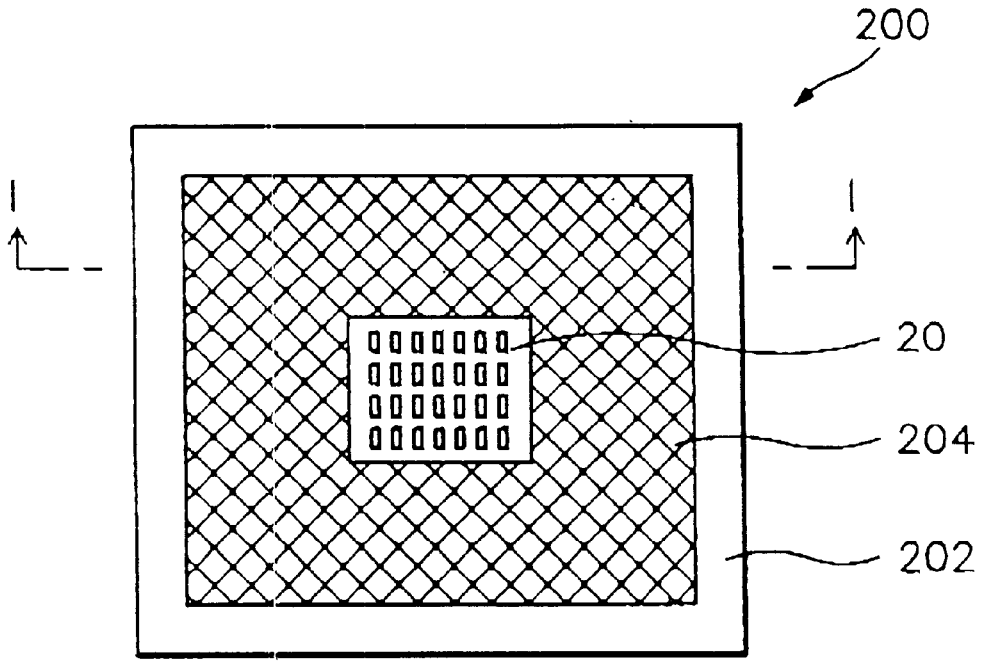
FIG. 6A is a plan view of a printing mask used to manufacture a spacer in a flat panel display in accordance with a third preferred embodiment of the invention.
Figure 6B:
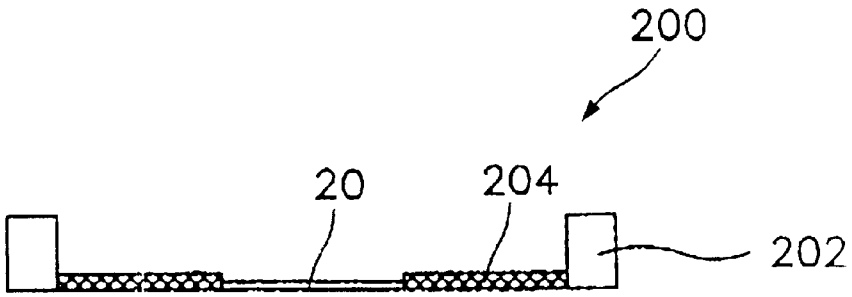
FIG. 6B is a cross sectional view of the printing mask shown in FIG. 6A taken in a line I–Idp.

In FIGS. 6A and 6B, a printing mask assembly 200 comprises a rectangular frame 202 made of a stainless steel and an inner plate 204 made of a polyester material provided in and surrounded by the rectangular frame 202. The inner plate 204 has in its center an aperture which selectively accommodates a first printing mask 20*a* and a second printing masks 20*b* shown in FIG. 7A and 7B, respectively. The first printing mask 20*a*, which will be used at the first printing sequence, has a plurality of tapered patterns for the spacer. Similarly, the second printing mask 20*b*, which will be used at the subsequent printing sequence, has also a plurality of tapered patterns for the spacer.

Figure 7A:
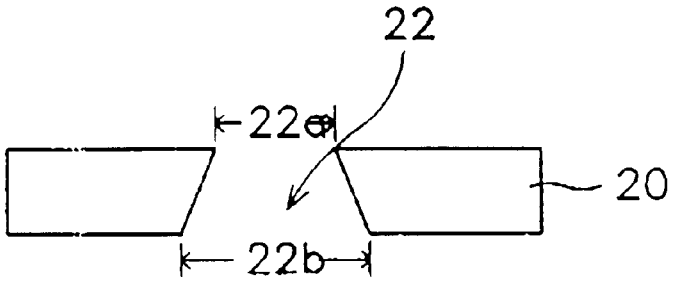
FIG. 7A is a sectional view of the printing mask shown in FIGS. 6A and 6B.
Figure 7B:
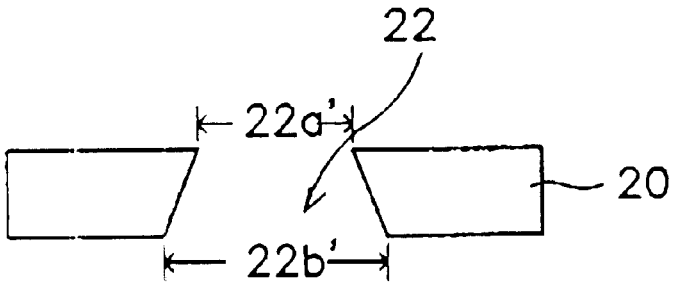
FIG. 7B is a sectional view of the printing mask shown in FIGS. 6A and 6B.

As is known by the experiment executed by the inventor, it is preferred that the thickness of the first printing mask 20*a* is approximately 50 μm and each of the tapered patterns thereof is 40 μm in its upper region 22*a* and 50 μm at its bottom region 22*b*, as depicted in FIG. 7A. On the other hand, the second printing mask 20*b* is about 100 μm in its thickness, in which each tapered pattern is about 60 μm in its upper region 22*a*' and 70 μm at its bottom region 22*b*', as depicted in FIG. 7B. Therefore, by employing the printing masks as described above, a spacer will have a height of 200 μm at the application of the 5 or 6 times printing sequences. The tapered patterns may be precisely made by way of, e.g., a laser process.

The above embodiment is applicable to all of the manufacturing procedures of the spacers employing the printing scheme which is irrelevant to the scheme employing the supporting plate and is capable of making the spacers more efficiently when it is incorporated with the supporting scheme.

Furthermore, in order to avoid the expanded base of the spacer as illustrated with reference to FIG. 5, a subsidiary member may be arranged to both sides of the spacer to block the spread of the paste or a recess is formed into the substrate to confine therein the flow of the paste for the spacer.

Figure 8A:
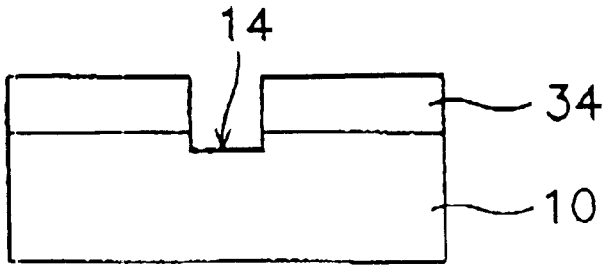
FIGS. 8A and 8B illustrate a procedure of manufacturing a spacer in a flat panel display in accordance with a fourth preferred embodiment of the invention.
Figure 8B:
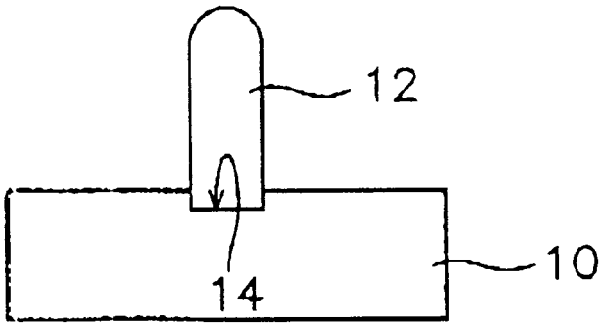

Referring to FIG. 8*a* to 8*b*, there is shown a procedure of manufacturing a spacer in the flat panel display in accordance with the fourth embodiment of the present invention wherein a recess is provided in a portion expected to be the spacer on the substrate.

First of all, in order to prepare the portion for the spacer, a photosensitive film 34 is coated on the substrate and then the photosensitive film 34 is subjected to a series of a conventional photo-developing process including a soft baking, a selective exposing, a selective developing and a post-exposed baking to expose the portion on the substrate 10. Thereafter, the exposed surface of the substrate 10 is downwardly etched by an appropriate depth through the use of either a wet etching employing an etching solution such as HF or a sand blustering technique to produce the recess 14, as shown in FIG. 8A. In this connection, it is necessary to make the depth of the recess 14 about 5 to 15 μm to some extent of preventing the bottom of the spacer 12 from being expanded.

Thereafter, a printing mask 20 is arranged on the substrate 10 and is printed to produce a base spacer 12 as illustrated in FIG. 8B.

Alternatively, an uneven member formed by, e.g., a rough surface process may be substituted for the recess.

Figure 9A:
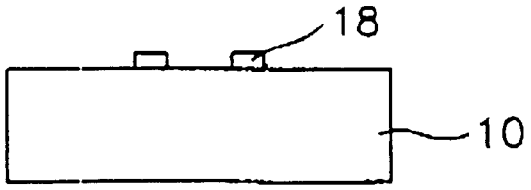
FIGS. 9A to 9C illustrate a procedure of manufacturing a spacer in a flat panel display in accordance with a fifth preferred embodiment of the invention.
Figure 9B:
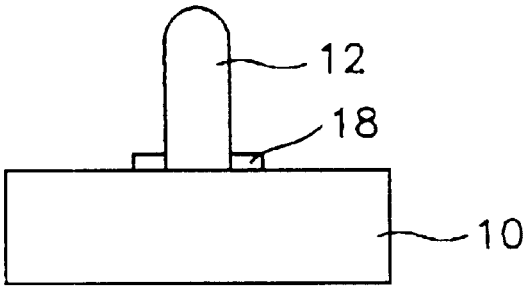
Figure 9C:
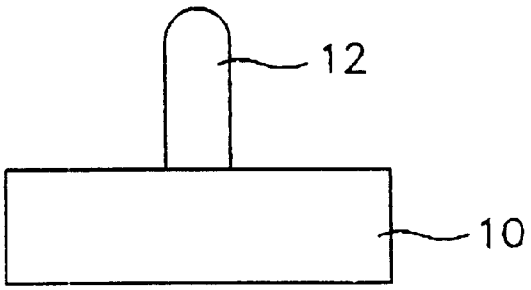

Referring to FIG. 9A to 9C, there is illustrated a procedure of manufacturing a spacer in the flat panel display in accordance with a fifth embodiment of the present invention wherein a subsidiary member is provided in both sides of a portion expected to be the spacer on the substrate.

First of all, in FIG. 9A, the subsidiary member 18 is formed at both sides of the portion expected to be the spacer to prevent of the flow of the paste. The subsidiary member 18 may be made by way of a photolithography technology employing a photosensitive film or the like. In this connection, it is preferred to make the depth of the subsidiary member 18 to about 5 to 15 $\mu$m where, to some extent, this prevents the bottom of the spacer 12 from being expanded.

Next, a printing mask 20 is arranged on the substrate 10. And then a printing process is applied to the printing mask so that the paste is confined by the subsidiary member 18 to thereby define a base spacer 12 without having an expanded bottom through the hole in the printing mask 20.

Thereafter, a subsequent printing process will be repeatedly applied to the base spacer through the use of the printing masks to make an extended spacer as illustrated in FIG. 8B.

The subsidiary member 18 may be constructed by a phosphor layer or a blackmatrix. The subsidiary member 18 is removed from the substrate after the application of the subsequent printing and drying processes, to thereby produce a finished spacer as depicted in FIG. 9C.

While the present invention has been described with respect to preferred embodiments, other modifications and variations may be made without departing from the scope of the present invention as set forth in the following claims.

What is claimed is:

1. A method for manufacturing a spacer [used in] for a flat panel display, comprising the steps of:

(a) placing a first printing mask on a substrate, wherein the printing mask is provided with a plurality of holes, each exposing a portion expected to be the spacer on the substrate;

(b) printing the spacers through the plurality of spacer holes and drying them, which constitutes the first-stage process of printing;

(c) positioning a supporting plate on the substrate after removing the first printing mask, wherein the supporting plate is provided with a plurality of holes which exposes their corresponding base spacers; and arranging a second printing mask on the supporting plate to apply a subsequent printing to extend the base spacer with a desired height, wherein the second printing mask used at the subsequent printing processes has an increased thickness and pattern width in comparison to that of the first printing mask which has been used to produce the base spacer.

2. The method according to claim 1 wherein in the subsequent printing process, an additional supporting plate whose thickness is substantially similar to that of the base spacer is provided for each of the printing processes.

3. The method according to claim 1, wherein in the subsequent printing process, an additional supporting plate whose thickness is substantially similar to that of the base spacer is provided once for every set of two or more subsequent printing processes.

4. A method for manufacturing a spacer for a flat panel display, comprising the steps of:

(a) placing a first printing mask on a substrate, wherein the printing mask is provided with a plurality of holes, each exposing a portion expected to be the spacer on the substrate;

(b) printing the base spacers through the plurality of spacer holes and drying them, which constitutes the first-stage process of printing; and (c) arranging a second printing mask incorporated in itself a supporting member on the substrate to apply a subsequent printing to extend the base spacer with a desired height after removing the first printing mask, wherein the supporting member has a plurality of holes exposing the base spacers, wherein the second printing mask used at the subsequent printing processes has an increased thickness and pattern width in comparison to that of the first printing mask which has been used to produce the base spacer.

5. The method according to claim 1, wherein the spacer is solidified by a sintering process for one time at the completion of the subsequent printing process or is repeatedly sintered for each of the printing sequences.

6. A method for manufacturing a spacer for a flat panel display, comprising the steps of:

(a) forming a recess in a portion expected to be a spacer on a substrate;

(b) arranging a first printing mask on the substrate, wherein the first printing mask has a hole to expose the recess;

(c) printing spacers on the recess through the plurality of spacer holes and drying them, which constitutes the first-stage process of printing;

(d) positioning a supporting plate on the substrate after removing the first printing mask, wherein the supporting plate has substantially a thickness similar to that of the base spacer and has a hole exposing the base spacer; and (e) arranging a second printing mask on the supporting plate to apply a subsequent printing and drying them in a dryer in order to extend the spacer with a desired height, which constitutes the second stage process of printing, wherein the second printing mask used at the subsequent printing processes has an increased thickness and pattern width in comparison to that of the first printing mask which has been used to produce the base spacer.

7. The method according to claim 6, wherein the recess is formed by a wet etching employing HF or a sand blustering method.

8. The method according to claim 7, wherein the recess includes an uneven member.

9. A method for manufacturing a spacer for a flat panel display, comprising the steps of:

(a) forming subsidiary members at both sides of a portion expected to be a spacer on a substrate;

(b) arranging a first printing mask on the substrate, wherein the first printing mask has a plurality of holes to expose the portion on which the spacer will be formed;

(c) printing spacers through the plurality of spacer holes and drying them, which constitutes the first-stage process of printing;

(d) positioning a supporting plate on the substrate between subsidiary members after removing the first printing mask, wherein the supporting plate has substantially a thickness similar to that of the base spacer and has a hole exposing the base spacer;

(e) arranging the second printing mask on the supporting plate to apply a subsequent printing and drying them in a dryer in order to extend the spacer with a desired height, which constitutes the second stage process of printing wherein the second printing mask used at the subsequent printing processes has an increased thickness and pattern width in comparison to that of the first printing mask which has been used to produce the base spacer; and (f) removing the subsidiary members from the substrate.

* * * * *